US006317113B1

(12) United States Patent
Wu

(10) Patent No.: US 6,317,113 B1
(45) Date of Patent: Nov. 13, 2001

(54) METHOD FOR DRIVING THIN FILM TRANSISTOR OF LIQUID CRYSTAL DISPLAY

(75) Inventor: Biing-Seng Wu, Tainan (TW)

(73) Assignee: Chi Mei Electronics Corp., Tainan (TW)

( * ) Notice: Subject to any disclaimer, the term of this patent is extended or adjusted under 35 U.S.C. 154(b) by 0 days.

(21) Appl. No.: 09/384,412

(22) Filed: Aug. 27, 1999

(51) Int. Cl.[7] ..... G09G 3/36

(52) U.S. Cl. ..... 345/92; 345/94

(58) Field of Search ..... 345/94, 95, 96, 345/97, 98, 99, 100, 87, 88, 89, 90, 91, 92, 93

(56) References Cited

U.S. PATENT DOCUMENTS 6,005,542 * 12/1999 Yoon ..... 345/92

* cited by examiner

*Primary Examiner*—Xiao Wu
(74) *Attorney, Agent, or Firm*—Rosenberg, Klein & Lee

(57) ABSTRACT

The present invention discloses a method for driving a tin film transistor, and more particularly, a method for driving a thin film transistor of a liquid crystal display. Voltage for driving a gate is changed such that peak values of the gate pulse voltage in positive field periodic scanning time and negative field periodic scanning time are not equal, and the difference therebetween is not larger than double of voltage peak value of a data signal line. Therefore, voltage reduction of liquid crystal capacitor can be decreased without enlarging the capacitance thereof. Further, since the gate voltage applied is smaller in a half of each period, the thin film transistor of the liquid crystal display is less influenced by an electric field and thus the voltage stress is reduced.

1 Claim, 7 Drawing Sheets

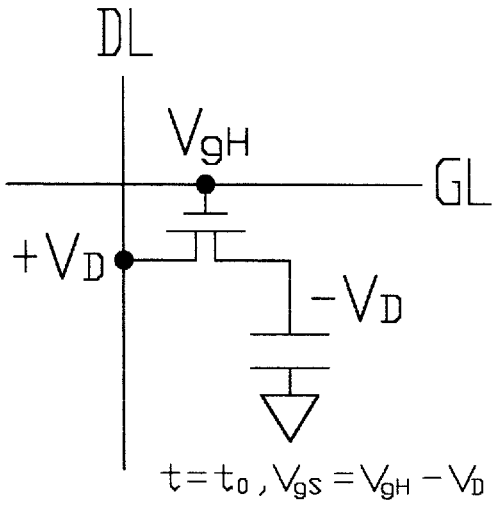
FIG.7A
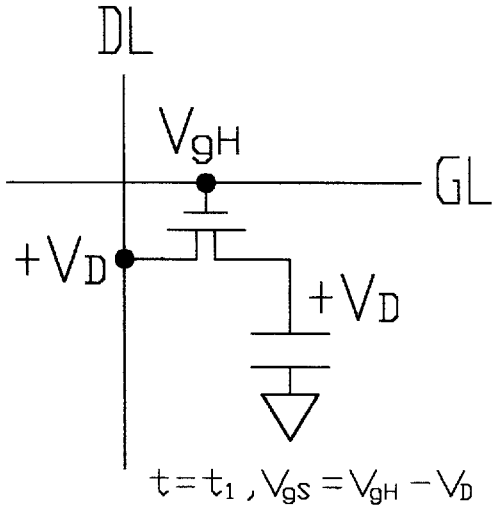
FIG.7B
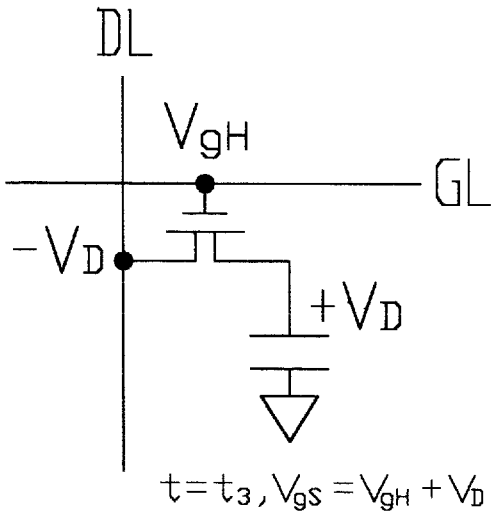
FIG.7C
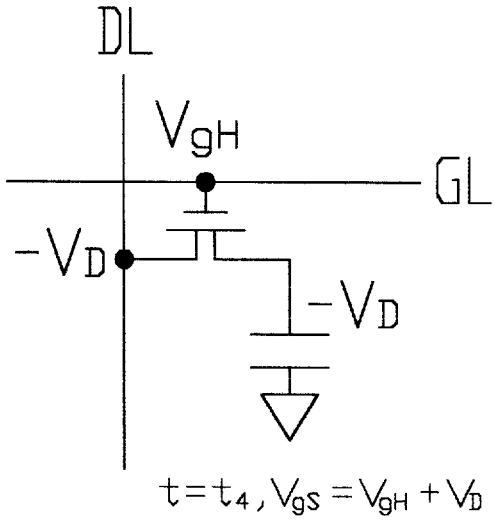
FIG.7D
FIG.7

METHOD FOR DRIVING THIN FILM TRANSISTOR OF LIQUID CRYSTAL DISPLAY

FIELD OF THE INVENTION

The present invention relates to a method for driving a thin film transistor (TFT), and more particularly, a method for driving a thin film transistor of a liquid crystal display (LCD).

BACKGROUND OF THE INVENTION

FIG. 1 shows a TFT, and FIG. 2 is a circuit diagram thereof. When a voltage $V_g$ applied to a gate of the TFT exceeds a threshold voltage $V_{TH}$, a drain and a source are conductive and a current $I_d$ is flown therebetween. FIG. 3 shows a curve of gate voltage $V_g$ versus current $I_d$. In the case of repeated usage of the TFT, a problem of drift of the threshold voltage $V_{TH}$ is produced, referring to FIG. 3. The relationship between the drifted voltage difference $\Delta V_{Th}$ and gate-source voltage $V_{gs}$ is shown in FIG. 4. Namely, the voltage difference $\Delta V_{TH}$ is increased as voltage stress caused by the gate-source voltage $V_{gs}$ is increased. The drift problem of the threshold voltage is particularly serious in the case of amorphous silicon TFT (a-Si TFT) formed by low temperature chemical vapor deposition (CVD).

FIG. 5 shows an architecture of an active matrix LCD using TFTs. A TFT is provided at each intersection of data signal lines DL and scanning lines GL. The TFT has a gate connected to the scanning line GL, a source connected to the data signal line DL, and a drain connected to a liquid crystal capacitor $C_{LC}$. A gate driving unit 20 sequentially provides each of the scanning lines with a gate scanning pulse voltage $V_g$ to sequentially select one corresponding gate line GL. When the gate scanning pulse voltage $V_g$ is applied, the TFT on the corresponding gate line GL is on. A data driving unit 10 provides each of the data signal line DL with an image signal $V_d$.

FIG. 6 is a timing chart showing a conventional N-channel TFT in which a voltage $V_d$ is applied to a gate scanning line. Time $t_0$ to $t_3$, $t_3$ to $t_5$, $t_5$ to $t_7$, . . . each is a field pen rod time $T_2$. In a field time, all the gate lines GL are sequentially scanned by the gate scanning unit 20. Time $t_0$ to $t_1$, $t_3$ to $t_4$, and $t_5$ to $t_6$ each is a horizontal selection period (horizontal scanning period) $T_1$. In $T_1$, $V_g$ is at high level ($V_{gH}$). In this case, a transistor on the gate scanning line is turned on and the image signal $V_d$ on the data signal line is written to a liquid crystal capacitor $C_{LC}$. In non-horizontal scanning time $T_3$, $V_g$ is at low level ($V_{gL}$). In this case, the transistor on the gate scanning line has a high impedance, which prevents the image signal $V_d$ on the liquid crystal capacitor $C_{LC}$ from leakage. The image signal is a NTSC video signal consisting of two interleaved field signals. A frame image is composed of two fields. A field time is 1/60second. That is, $T_2$=16.7 ms. As to $T_1$, it depends on the number of scanning lines, it is equal to 63.5 $\mu$s in the case of 480 scanning lines.

FIG. 7 shows an ideal relation between voltages of a gate, source and drain of a TFT and voltage $V_{gs}$ at the initial moment of gate scanning pulse voltage $V_g$ between two field times (i.e., instants of on and off of the transistor). FIGS. 7A and 7B show voltage variations when $t=t_0$ and $t=t_1$, respectively. Since the voltage $V_d$ applied to the gate of the transistor is $+V_D$, such a field is referred to as positive field. In this case, $V_{gs}=V_{gH}-V_D$, and drain voltage is charged from $-V_D$ on the liquid crystal capacitor $C_{LC}$ to $+V_D$. FIGS. 7C and 7D show voltage variations when $t=t_3$ and $t=t_4$, respectively. Since the voltage $V_d$ applied to the gate of the transistor is $-V_D$, such a field is referred to as negative field. In this case, $V_{gs}=V_{gH}+V_D$, and drain voltage is discharged from $+V_D$ on the liquid crystal capacitor $C_{LC}$ to $-V_D$. In both cases, there is a difference of $2V_D$, which readily causes a variation in electric field stress and thus $\Delta V_{TH}$ is produced.

FIG. 8 shows variation of the liquid crystal capacitor $C_{LC}$ in a frame period. In the horizontal selection time of the positive field ($t=t_0$~$t_1$), the image signal $V_d$ is $+V_D$, and thus the liquid crystal capacitor $C_{LC}$ starts to charge. When the scanning pulse ends, the TFT is turned off and the charge is maintained on the liquid crystal capacitor $C_{LC}$. In the horizontal selection time of the negative field ($t=t_3$~$t_4$), the image signal $V_d$ is $-V_D$, and thus the liquid crystal capacitor $C_{LC}$ starts to discharge. When the scanning pulse ends, the TFT is turned off and the charge is maintained on the liquid crystal capacitor $C_{LC}$. However, at the moment when the transistor is turned off, a voltage drop of $\Delta V_d$ is produced on the liquid crystal capacitor $C_{LC}$. The quantity of $\Delta V_d$ depends on stray capacitance $C_{GD}$ between the gate and the drain of the TFT, the liquid crystal capacitance, and voltage variation of scanning line $\Delta V_g=(V_{gH}-V_{gL})$ Namely, $\Delta V_d^{+}=\Delta V_d^{-}=\Delta V_d=[C_{GD}/(C_{GD}+C_{LC})]\times\Delta V_g$. Such a voltage drop (shifted voltage) is irrelevant to polarity of the image signal. Therefore, according to the prior art, a common electrode potential $V_{COM}$ of a color filter is set to be lower than the central potential of the signal line by such a shift value, so that the voltage applied on the liquid crystal is symmetric with respect to the origin except at the charging time and discharging time.

However, since dielectric coefficient of an actual liquid crystal is anisotropic, capacitance of the liquid crystal capacitor $C_{LC}$ and the shift voltage $\Delta V_d$ are varied due to amplitude of the image signal. Therefore, even the common electrode potential $V_{COM}$ is optimized, the voltage applied on the liquid crystal is asymmetric. Such an asymmetric component is an optical component of 30 Hz, and flicker phenomenon is observed. To avoid flicker, the shift voltage $\Delta V_d$ is minimized. To this end, the TFT is minimized and a holding capacitor $C_{ST}$ is connected to $C_{LC}$ in parallel, such that $\Delta V_d=[C_{GD}/(C_{GD}+C_{LC}+C_{ST})]\times\Delta V_g$. Such a shift voltage $\Delta V_d$ is equivalent to D.C. potential between the signal line and pixel electrode. When a D.C. potential exists in a liquid crystal layer, a residual image is generated, thereby reducing reliability of the liquid crystal. Therefore, $\Delta V_d$ must be minimized to obtain high picture quality and high reliability.

Nevertheless, due to restrictions of TFT manufacture, it is difficult to decrease the stray capacitance $C_{GD}$. Thus, the best way is to increase capacitance of the holding capacitor $C_{ST}$, which reduces open ratio of the liquid crystal display, and makes structure thereof complicated.

SUMMARY OF THE INVENTION

An object of the present invention is to set forth a method for driving TFTs in a LCD in which a shift voltage of a central voltage level of liquid crystal capacitors connected to the TFTs is reduced to enhance uniformity of the LCD.

Another object of the present invention is to provide a method for driving TFTs in a LCD in which the TFTs have lower holding capacitances to enhance open ratio of the LCD.

A further object of the present invention is to provide a method for driving TFTs in a LCD in which the TFTs of the LCD are not readily influenced by an electric field and thus the voltage stress caused is reduced.

To achieve the above objects, the present invention provides a method for driving a TFT wherein voltage for driving a gate is changed such that peak values of the gate pulse voltage in a first field and a second field are not equal, and the difference therebetween is not larger than double of voltage peak value of a image data. Therefore, voltage reduction of a liquid crystal capacitor can be decreased without enlarging the capacitance thereof. Further, since the gate voltage applied is smaller in a half of each period, the TFT of the LCD is less influenced by an electric field and thus the voltage stress is reduced so that $\Delta V_{TH}$ is not remarkably affected.

These and other objects, features and advantages of the present invention will become apparent to those skilled in the art upon consideration of the following description of the preferred embodiments of the present invention taken in conjunction with the accompanying drawings.

BRIEF DESCRIPTION OF THE DRAWINGS

FIG. 7 shows states at moments of on/off in a field period of a conventional TFT.

DETAILED DESCRIPTION

Figure 1:
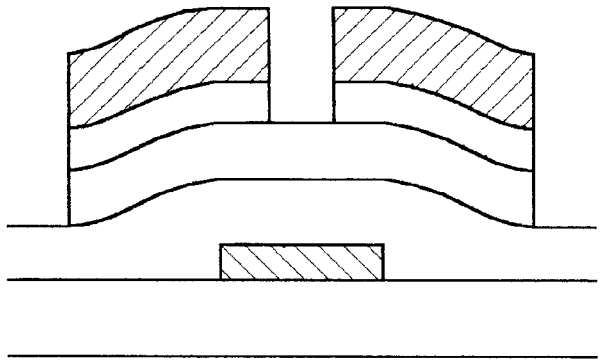
FIG. 1 is a schematic view of a TFT.
Figure 2:
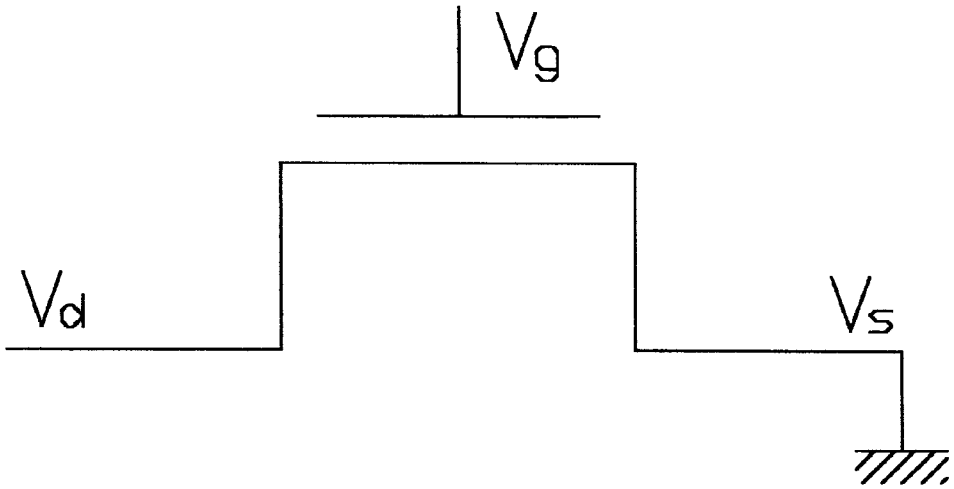
FIG. 2 shows a circuit representing a TFT.
Figure 3:
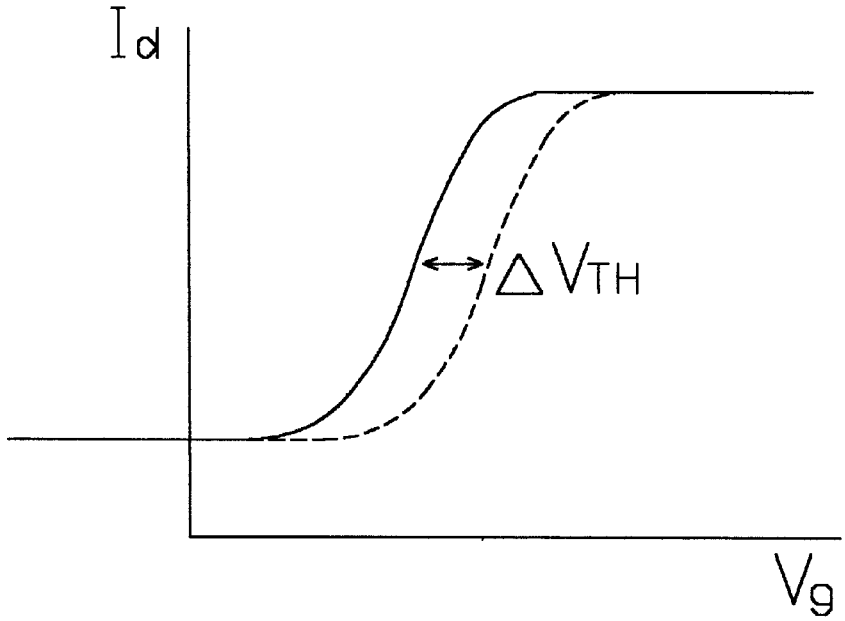
FIG. 3 shows relation between gate voltage and drain current in a TFT.
Figure 4:
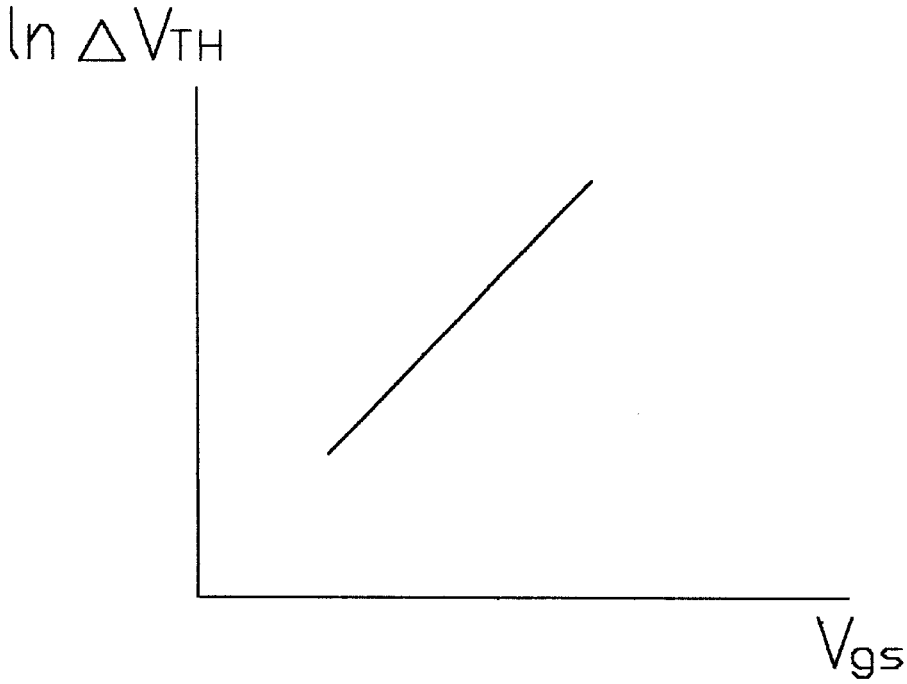
FIG. 4 shows relation between threshold voltage drift and gate-source voltage in a TFT.
Figure 5:
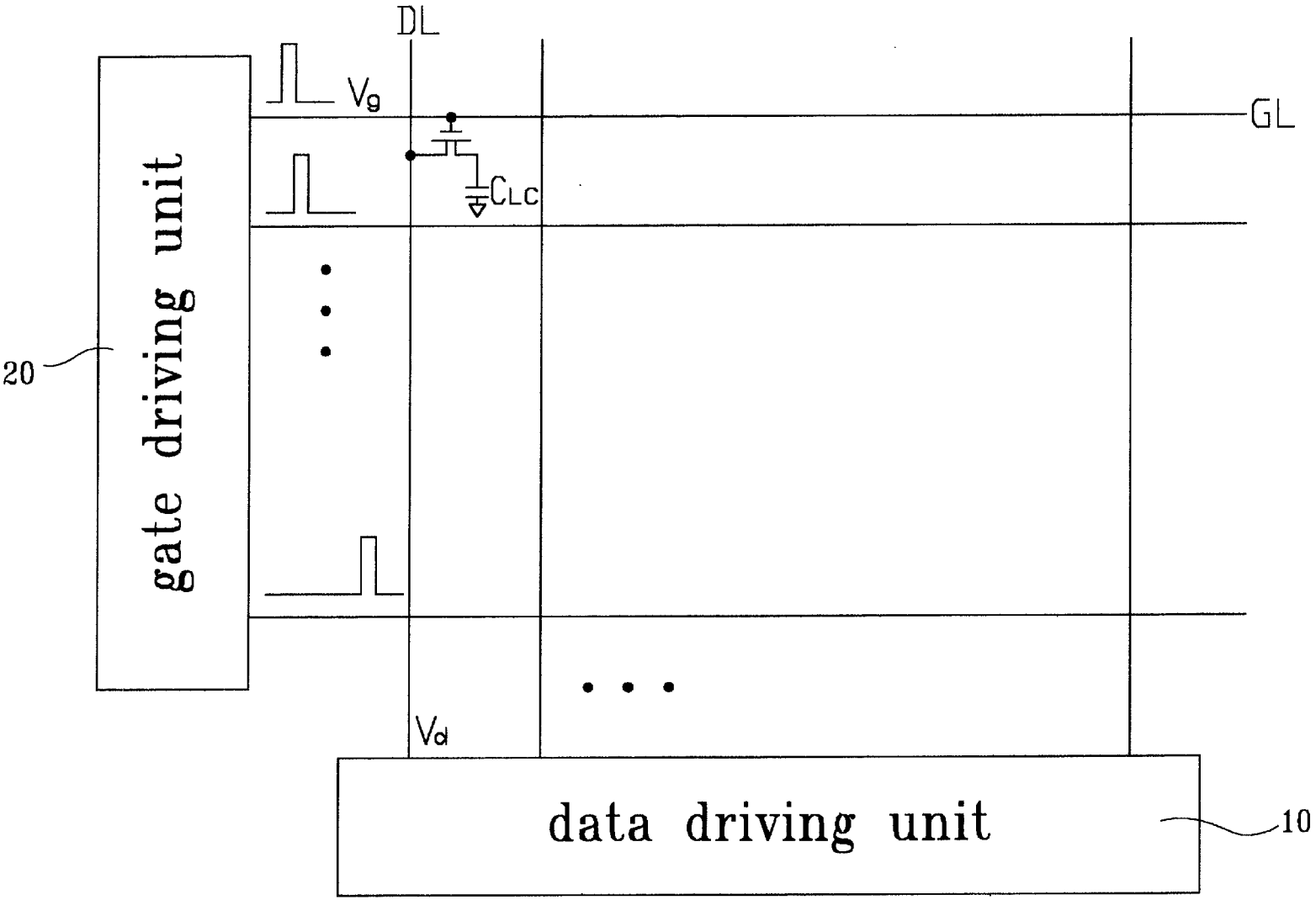
FIG. 5 shows an architecture of an active matrix LCD constituted by conventional TFTs.
Figure 6:
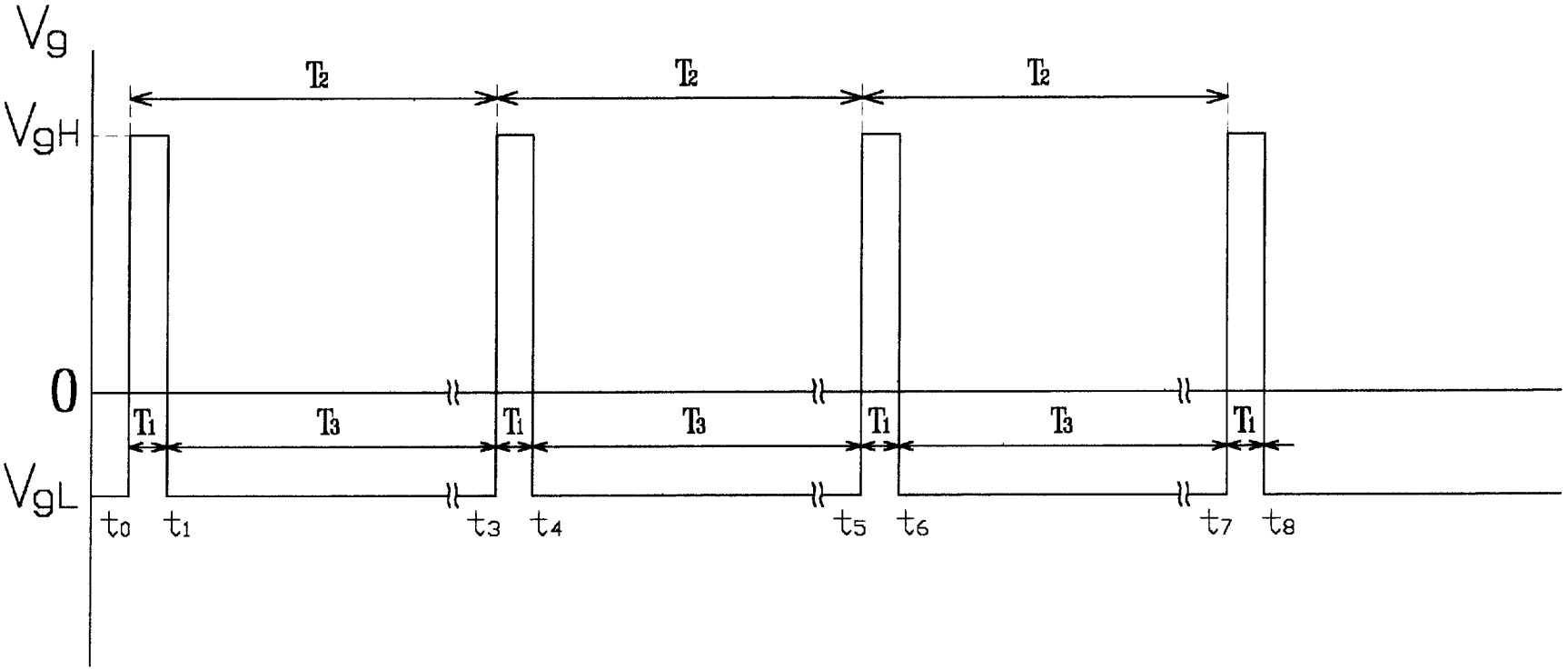
FIG. 6 is a view showing a gate driving signal applied in a transistor according to the prior art.
Figure 8:
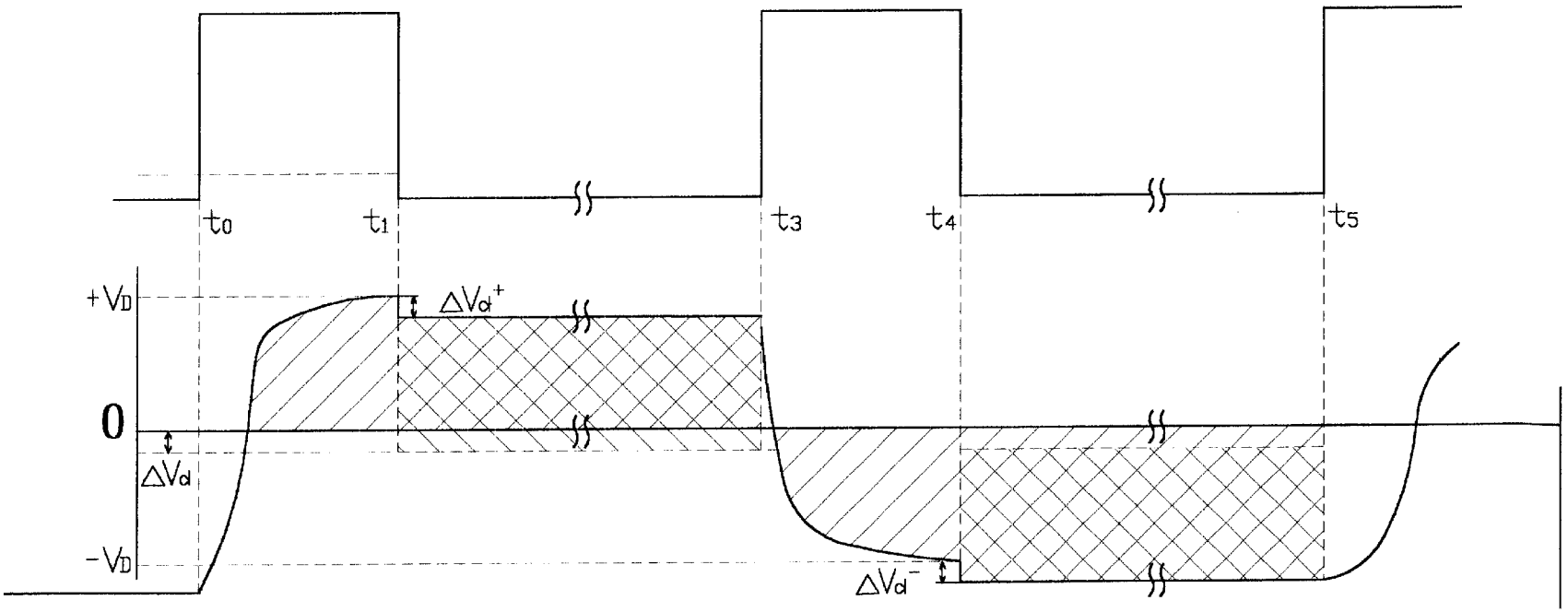
FIG. 8 shows voltage variation of a capacitance of a conventional liquid crystal in a field period.

As known from the description with reference to FIG. 8, formation of $\Delta V_d^+$ and $\Delta V_d^-$ is caused by the inevitable stray capacitance $C_{GD}$. In addition to the stray capacitance $C_{GD}$, holding capacitor $C_{ST}$ and liquid crystal capacitance $C_{LC}$, it also depends on the voltage difference $\Delta V_g$ between high potential and low potential of the gate voltage $V_g$, i.e., the difference between $V_{gH}$ and $V_{gL}$. If either $\Delta V_d^+$ or $\Delta V_d^-$ is decreased, $\Delta V_d=(\Delta V_d^++\Delta V_d^-)/2$ is decreased too.

Figure 9:
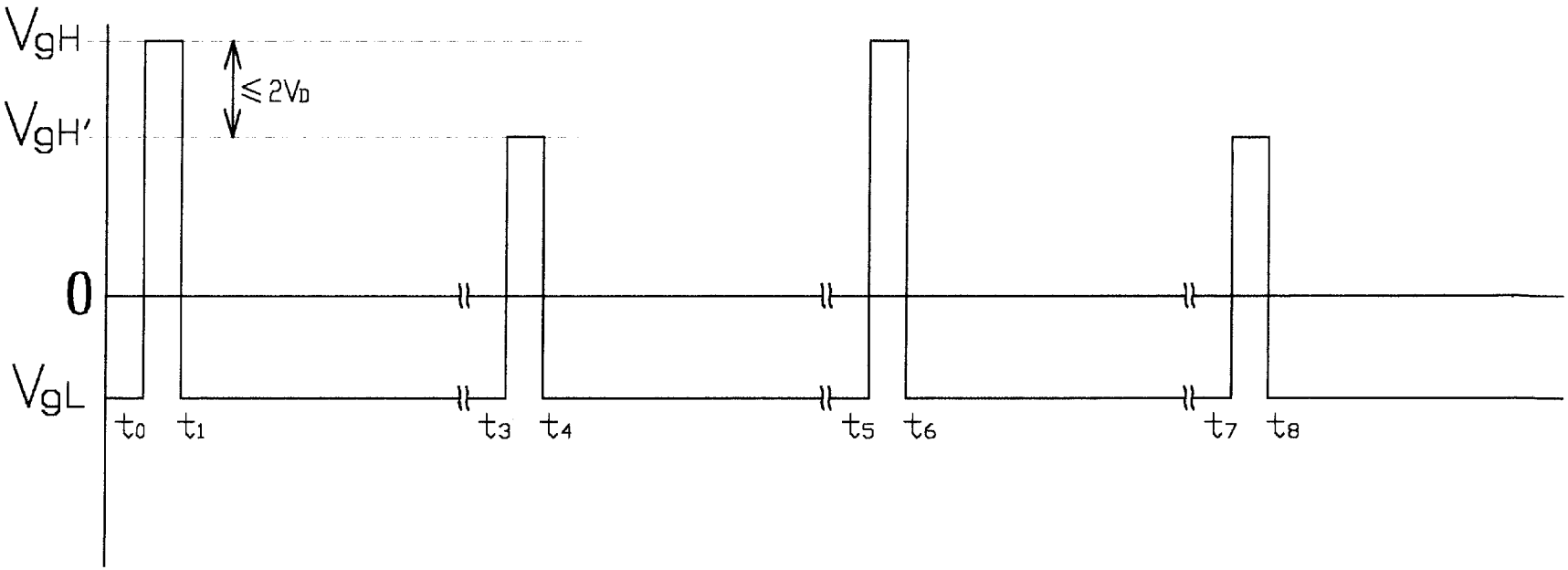
FIG. 9 shows a gate scanning signal according to the method for driving a TFT of the present invention.

FIG. 9 shows an embodiment of the present invention. According to the embodiment, a TFT has N channel, which means that the transistor is conductive when a positive voltage pulse is applied. If P channel is used, then the voltage polarity is reverse, which is obvious to those skilled in this field and thus the description is omitted. In a second field (negative field), high voltage drop of a pulse signal of a gate driving unit 20 is $V_{gH}'$. Preferably, $V_{gH}'=V_{gH}-2V_D$. By means of this relationship, in the second field, voltage difference $\Delta V_g$ between the high and low potentials of the pulse signal of the gate driving unit 20 is reduced, so that $\Delta V_d^-$ is decreased and the central voltage level shift $\Delta V_d$ is also decreased. The central voltage level shift $\Delta V_d$ of the respective TFTs is decreased and thus uniformity is enhanced without increasing capacitance of the holding capacitor $C_{ST}$.

With respect to the high level of the gate scanning pulse voltage in the negative field lower than that in the positive field by $2V_D$, please refer to the description with reference to FIG. 7. In this case, $V_{gs}$ in the positive field is equal to $V_{gH}-V_D$, but $V_{gs}$ in the negative field is equal to $V_{gH}'+V_D$, i.e., $V_{gH}-2V_D+V_D=V_{gH}V_D$, which is the same as that in the positive field. Therefore, voltage stress in both positive and negative fields is identical, and thus $V_{TH}$ won't be drifted.

Summing up the above, according to the present invention, a method for driving a gate of a TFT is proposed in which peak values of a gate scanning voltage pulse signal in a first field and a second field are different, and the voltage difference therebetween is not larger than double of peak value $V_D$ of a data signal line. If more than one peak value of data is present, peak value $V_D$ of the data signal line is the lower one of said peak values of the data signals. If the voltage difference is larger than double of the peak value $V_D$ of the data signal line, it might occur that the transistor cannot be turned on or the response is slow. Generally, the present invention possesses the following advantages in view of characteristics of capacitance of a liquid crystal and a TFT.

(1) Uniformity can be improved without increasing the capacitance.

(2) In comparison with the prior art, in the case of the same uniformity, the holding capacitance according to the present invention is lower, and thus the open ratio is higher.

(3) According to the present invention, since a lower gate driving voltage is used in one of the fields, the TFT is less susceptible to the applied voltage, thereby reducing variation of voltage stress.

While the present invention has been described in conjunction with preferred embodiment thereof, it is evident that many alternatives, modifications and variations will be apparent to those skilled in the art. Accordingly, it is intended to embrace all such alternatives, modifications and variations that fall within the spirit and scope thereof as set forth in the appended claims.

What is claimed is:

1. A method for driving a thin film transistor, including a gate, a drain and a source, of a liquid crystal display, said method comprises the step of applying a scanning pulse voltage signal and a data signal to said gate and said drain, respectively, wherein said scanning pulse voltage signal applied to said gate is used to control conduction between said drain and said source and transmission of said data signal between said source and said drain, said scanning pulse voltage is periodic, each period frame thereof consists of a first field and a second field, and in horizontal selection time of said first field said data signal is a positive voltage signal while in horizontal selection time of said second field said data signal is a negative voltage signal, said method being characterized in that peak values of the gate pulse voltage in the horizontal scanning times of the first field and second field are different, and the difference between the peak values is not larger than double of the lower one of the peak values of the data signals.

* * * * *